US008733561B2

(12) United States Patent
Kao

(10) Patent No.: US 8,733,561 B2
(45) Date of Patent: May 27, 2014

(54) SLEEVE BRACKET ASSEMBLY

(76) Inventor: Jui-Chien Kao, Taichung (TW)

( * ) Notice: Subject to any disclaimer, the term of this patent is extended or adjusted under 35 U.S.C. 154(b) by 371 days.

(21) Appl. No.: 13/199,991

(22) Filed: Sep. 14, 2011

(65) Prior Publication Data

US 2013/0062480 A1 Mar. 14, 2013

(51) Int. Cl.
*A47F 7/00* (2006.01)
*B65D 85/28* (2006.01)
*A47F 5/08* (2006.01)

(52) U.S. Cl.
USPC ..... 211/70.6; 211/94.01; 206/378

(58) Field of Classification Search
USPC ..... 211/69.1, 70.6, 94.1, 94.01; 206/378, 206/493, 349
See application file for complete search history.

(56) References Cited

U.S. PATENT DOCUMENTS 2,867,857 A * 1/1959 McCarthy ..... 52/584.1
2,952,341 A * 9/1960 Weiler ..... 52/588.1
3,324,617 A * 6/1967 Knight et al. ..... 52/481.1
4,209,098 A * 6/1980 Adams ..... 211/70.8
4,450,970 A * 5/1984 Shepherd ..... 211/189
4,607,753 A * 8/1986 Radek ..... 211/94.01
4,826,021 A * 5/1989 Burrell ..... 211/70.6
4,927,020 A * 5/1990 Randy ..... 206/378
5,217,115 A * 6/1993 Purkapile ..... 206/373
5,284,245 A * 2/1994 Slivon et al. ..... 206/378
5,398,823 A * 3/1995 Anders ..... 211/70.6
5,409,120 A * 4/1995 Miller et al. ..... 211/85.26
5,425,519 A * 6/1995 Budert ..... 248/214
5,467,874 A * 11/1995 Whitaker ..... 206/378
5,725,107 A * 3/1998 Dembicks ..... 211/70.6
D393,909 S * 4/1998 Current ..... D25/123
5,791,093 A * 8/1998 Diamond ..... 52/36.5
5,819,490 A * 10/1998 Current ..... 52/588.1
5,855,284 A * 1/1999 Dembicks ..... 211/70.6
5,862,913 A * 1/1999 Chou ..... 206/378
5,899,344 A * 5/1999 Current et al. ..... 211/94.01
6,032,797 A * 3/2000 Kao ..... 206/378
6,070,745 A * 6/2000 Dembicks ..... 211/70.6
6,325,223 B1 * 12/2001 Hannen ..... 211/87.01
6,386,363 B1 * 5/2002 Huang ..... 206/378
6,450,338 B1 * 9/2002 Chen ..... 206/378
6,488,151 B2 * 12/2002 Ramsey et al. ..... 206/378
6,494,329 B1 * 12/2002 Dembicks ..... 211/70.6
6,712,225 B2 * 3/2004 McNeely ..... 211/70.6
6,991,105 B2 * 1/2006 Winnard ..... 206/378
D533,283 S * 12/2006 Holztrager ..... D25/123
7,198,159 B2 * 4/2007 Fischer ..... 211/94.01
7,232,121 B2 * 6/2007 Haruna ..... 269/309
7,571,571 B1 * 8/2009 Mershon ..... 52/36.5
7,669,723 B2 * 3/2010 Kao ..... 211/70.6
7,717,279 B2 * 5/2010 Lawson ..... 211/94.01
7,802,680 B2 * 9/2010 Krebs et al. ..... 206/349

(Continued)

*Primary Examiner* — Darnell Jayne
*Assistant Examiner* — Kimberly S Wright
(74) *Attorney, Agent, or Firm* — William E. Pelton, Esq.; Cooper & Dunham LLP

(57) ABSTRACT

A sleeve bracket assembly has a frame and multiple first sleeve mounts. The frame has a first sleeve track having a groove. Each first sleeve mount has a base and a hollow positioning button protruding from a top surface of the base and having a retractable protrusion or a flange. The cross section of the base or the positioning button of each first sleeve mount is round, so sleeves can be rotated. The protrusions and the flanges can securely position the sleeves. Accordingly, the sleeve bracket assembly can position the sleeves firmly and also allow the sleeves to be rotated.

2 Claims, 15 Drawing Sheets

(56) References Cited

U.S. PATENT DOCUMENTS

| | | | | |
|---|---|---|---|---|
| 7,905,354 | B1 * | 3/2011 | Geibel | 206/378 |
| 8,152,003 | B1 * | 4/2012 | Kao | 211/70.6 |
| 8,267,363 | B2 * | 9/2012 | Begic et al. | 248/221.11 |
| 8,336,709 | B1 * | 12/2012 | Geibel | 206/378 |
| 8,381,905 | B1 * | 2/2013 | Kao | 206/378 |
| 8,403,155 | B1 * | 3/2013 | Kao | 211/70.6 |
| 8,479,929 | B1 * | 7/2013 | Kao | 211/70.6 |
| 8,499,935 | B2 * | 8/2013 | Hsieh | 206/378 |
| 8,517,188 | B2 * | 8/2013 | Kao | 211/70.6 |
| 2003/0150824 | A1 * | 8/2003 | McNeely | 211/70.6 |
| 2003/0233926 | A1 * | 12/2003 | Makropoulos | 83/829 |
| 2004/0124164 | A1 * | 7/2004 | Perkins et al. | 211/94.01 |
| 2006/0091094 | A1 * | 5/2006 | Schuberth | 211/94.01 |
| 2007/0056921 | A1 * | 3/2007 | Lo | 211/94.01 |
| 2007/0210021 | A1 * | 9/2007 | Whitehead et al. | 211/70.6 |
| 2007/0221594 | A1 * | 9/2007 | Pierro | 211/94.01 |
| 2009/0090644 | A1 * | 4/2009 | Kao | 206/373 |
| 2009/0134290 | A1 * | 5/2009 | Begic et al. | 248/222.13 |
| 2010/0065520 | A1 * | 3/2010 | Hsieh | 211/70.6 |
| 2011/0048989 | A1 * | 3/2011 | Winnard | 206/378 |
| 2011/0089126 | A1 * | 4/2011 | Hsieh | 211/70.6 |
| 2012/0096698 | A1 * | 4/2012 | Ernst | 29/428 |
| 2013/0037498 | A1 * | 2/2013 | Kao | 211/59.2 |
| 2013/0062480 | A1 * | 3/2013 | Kao | 248/201 |
| 2013/0068643 | A1 * | 3/2013 | Hsieh | 206/349 |
| 2013/0153521 | A1 * | 6/2013 | Kao | 211/70.6 |
| 2013/0186243 | A1 * | 7/2013 | Harper et al. | 81/180.1 |

* cited by examiner

SLEEVE BRACKET ASSEMBLY

BACKGROUND OF THE INVENTION

1. Field of the Invention

The present invention relates to a sleeve bracket assembly, and more particularly to a sleeve bracket assembly positioning sleeves securely and also allowing the sleeves to be rotated.

2. Description of Related Art

A conventional sleeve bracket assembly has a frame and a mount device. The mount device has multiple sleeve mounts connected with the frame. Each sleeve mount has a rectangular base and a round button. Each button protrudes from a top surface of the base and can be inserted into a sleeve. Because each button is round, the sleeve can be rotated and allow a number or a sign on the sleeve to face a user. However, each button lacks a positioning structure and cannot securely hold the sleeve. The sleeves easily fall off from the buttons.

Another sleeve mount of a conventional sleeve bracket assembly has a rectangular base and a rectangular button. Each button has a retractable protrusion used for abutting a recess of an inner surface of the sleeve. Therefore, the sleeves can be firmly positioned. Nevertheless, the buttons are rectangular and cannot allow the sleeves to be rotated.

Moreover, a conventional sleeve bracket assembly can merely display one set of sleeves that have slightly different sizes. An additional sleeve bracket assembly is required to receive another set of sleeves. For example, three sleeve bracket assemblies are needed to receive whole sets of sleeves that comprise complete sizes.

However, purchasing new sleeve bracket assemblies increases a purchasing cost and carrying multiple sleeve bracket assemblies is inconvenient.

To overcome the shortcomings, the present invention tends to provide a sleeve bracket assembly to mitigate the aforementioned problems.

SUMMARY OF THE INVENTION

The main objective of the invention is to provide a sleeve bracket assembly positioning sleeves securely and also allowing the sleeves to be rotated.

A sleeve bracket assembly has a frame and multiple first sleeve mounts. The frame has a first sleeve track having a groove. Each first sleeve mount has a base and a hollow positioning button protruding from a top surface of the base and having a retractable protrusion or a flange. The cross section of the base or the positioning button of each first sleeve mount is round, so sleeves can be rotated. The protrusions and the flanges can securely position the sleeves. Accordingly, the sleeve bracket assembly can position the sleeves firmly and also allow the sleeves to be rotated.

Other objects, advantages and novel features of the invention will become more apparent from the following detailed description when taken in conjunction with the accompanying drawings.

DETAILED DESCRIPTION OF PREFERRED EMBODIMENT

Figure 1:
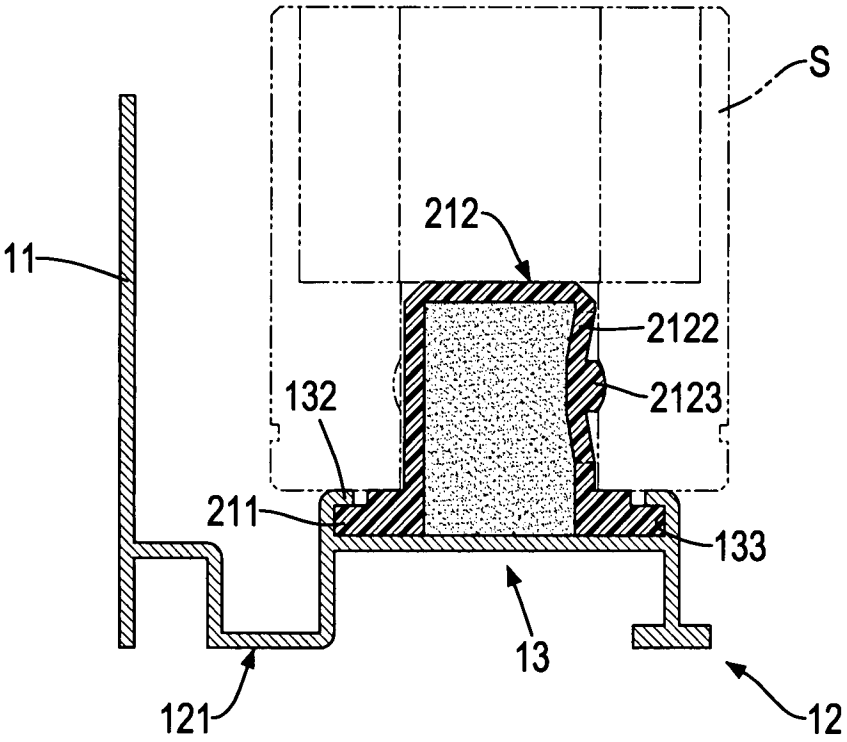
FIG. 1 is an enlarged cross sectional side view of a first embodiment of a sleeve bracket assembly in accordance with the present invention.
Figure 2:
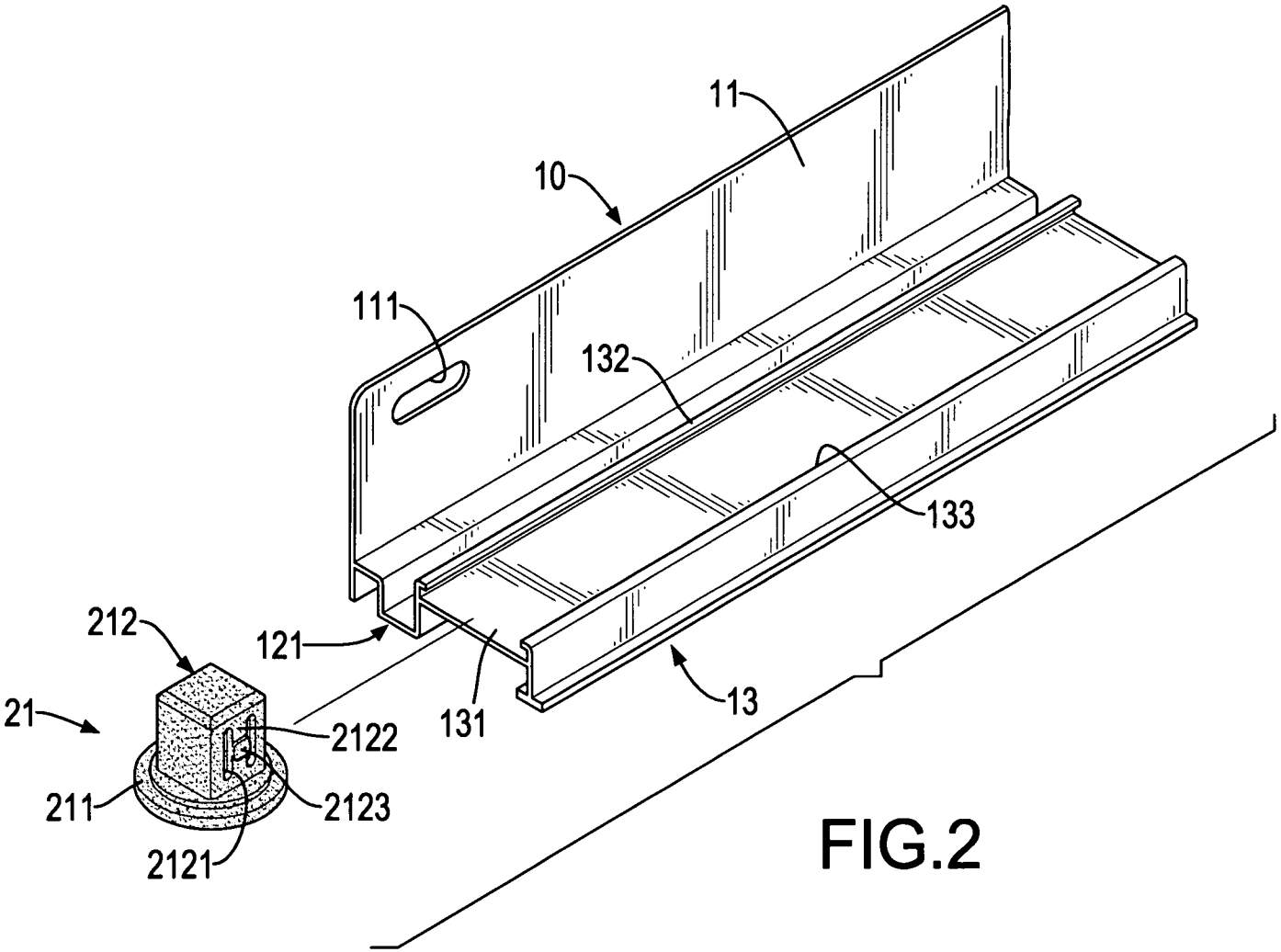
FIG. 2 is a partially exploded perspective view of the sleeve bracket assembly in FIG. 1.

With reference to FIGS. 1 to 4, a first embodiment of a sleeve bracket assembly in accordance with the present invention comprises a frame 10 and a first mount device 20.

The frame 10 is made of aluminum and has a back plate 11, a bracket unit 12 and a first sleeve track 13.

The back plate 11 is elongated and has a top, a bottom, two opposite ends, a length, a side surface and two mounting holes 111. The bottom of the back plate 11 is opposite to the top of the back plate 11. The mounting holes 111 are formed through near the top and respectively near the opposite ends of the back plate 11. The frame 10 can be placed at or hung on a flat plane by the mounting holes 111.

The bracket unit 12 is formed integrally on the side surface of the back plate 11 and has a top surface and a length. The length of the bracket unit 12 is the same as that of the back plate 11.

The first sleeve track 13 is linear, is formed on and protrudes from the top surface of the bracket unit 12, extends along a line parallel to an extending line of the back plate 11 and has a top surface 131, two bars 132 and a groove 133. The top surface 131 of the first sleeve track 13 is rectangular and has two opposite edges. The bars 132 are respectively formed on the edges of the top surface 131 of the first sleeve track 13. Each bar 132 has a bent top facing that of the other bar 132. The groove 133 is formed between the top surface 131 and the bars 132 of the first sleeve track 13.

The first mount device 20 has multiple first sleeve mounts 21. The first sleeve mounts 21 are detachably connected with the first sleeve track 13. Each first sleeve mount 21 has a base 211 and a positioning button 212. The base 211 of each first sleeve mount 21 is slidably and rotatably mounted in the groove 133 and has a top surface and a round cross section. The positioning button 212 of each sleeve mount 21 is hollow and is formed on and protrudes from the top surface of the base 211 and has a rectangular cross section, a side surface, two openings 2121, a resilient section 2122 and a protrusion 2123. The openings 2121 of each first sleeve mount 21 are respectively formed through the side surface of the positioning button 212. The resilient section 2122 of each first sleeve mount 21 is formed between the openings 2121 of the positioning button 212 and has a central segment. The protrusion 2123 of each first sleeve mount 21 is formed on and protrudes outward from the central segment of the resilient section 2122 of the first sleeve mount 21. Preferably, the positioning buttons 212 of the first mount device 20 have the same size.

Figure 3:
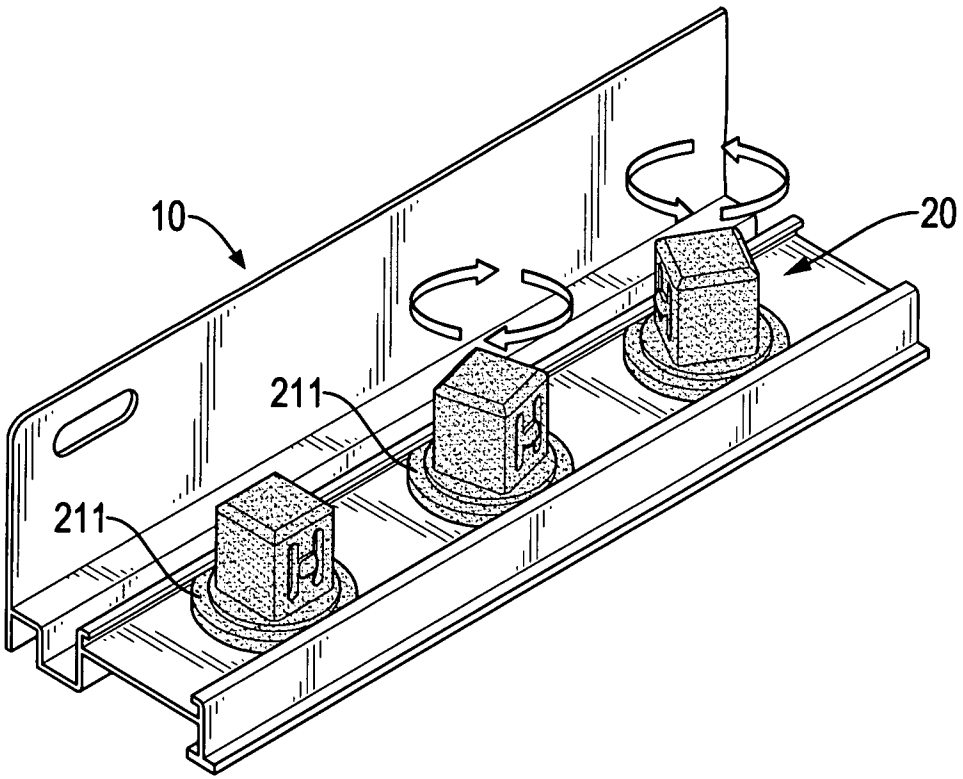
FIG. 3 is an enlarged operational perspective view of the sleeve bracket assembly in FIG. 1.
Figure 4:
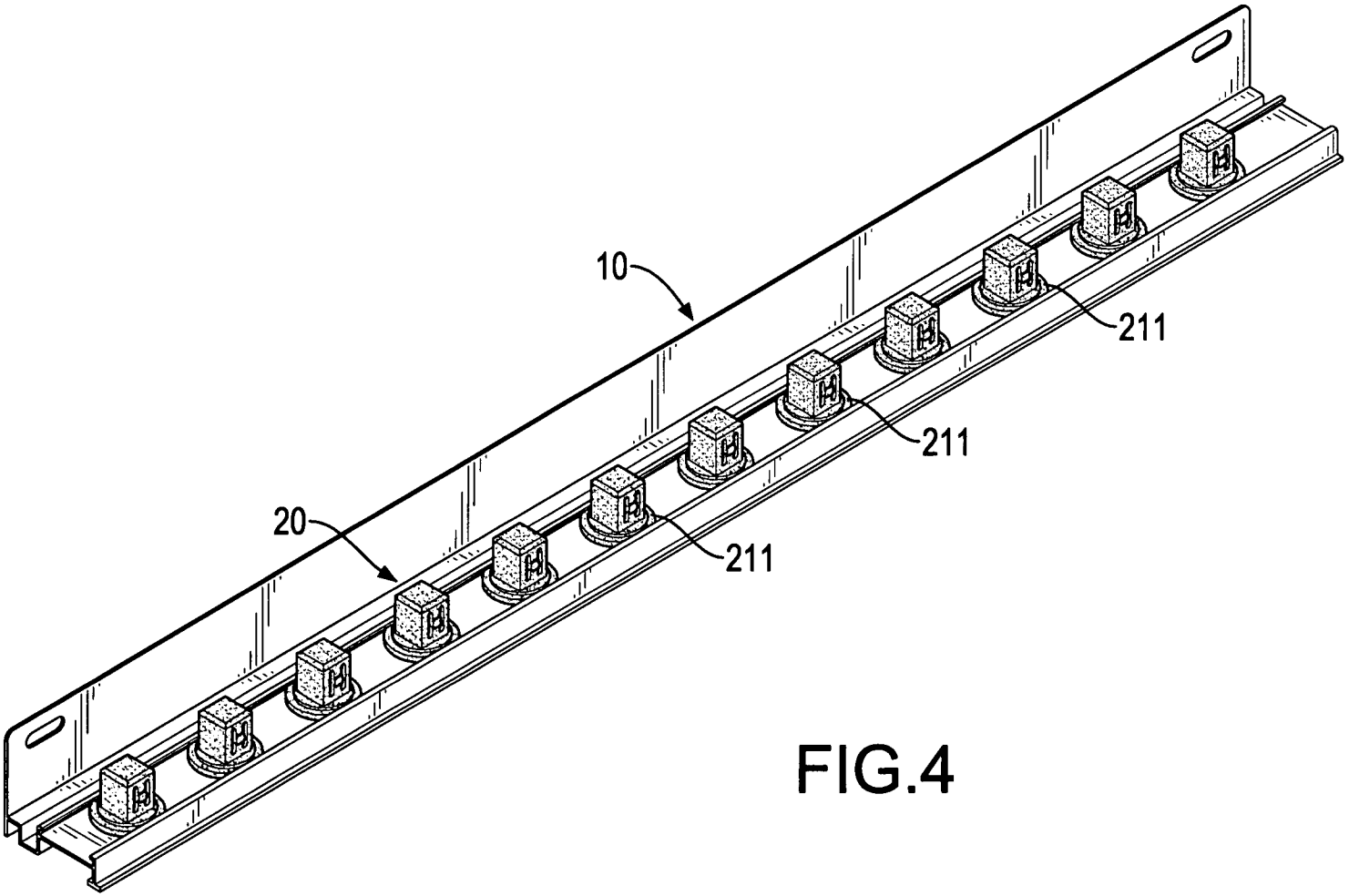
FIG. 4 is a perspective view of the sleeve bracket assembly in FIG. 1.

With reference to FIGS. 1 and 3, multiple sleeves S are respectively and detachably mounted around the positioning buttons 212. The sleeves S can be rotated because the bases 211 are round and are rotatably mounted in the groove 133. Accordingly, a number or a sign on each sleeve S can be rotated to face a user. When each sleeve S is inserted by the positioning button 212, the resilient section 2122 is bent inwardly by an inner surface of the sleeve S. Consequently, the resilient section 2122 recovers and the protrusion 2123 is embedded in a recess of the inner surface of the sleeve S to position the sleeve S. Accordingly, the sleeve bracket assembly in accordance with the present invention can position the sleeves S securely and also allow the sleeves S to be rotated.

Figure 5:
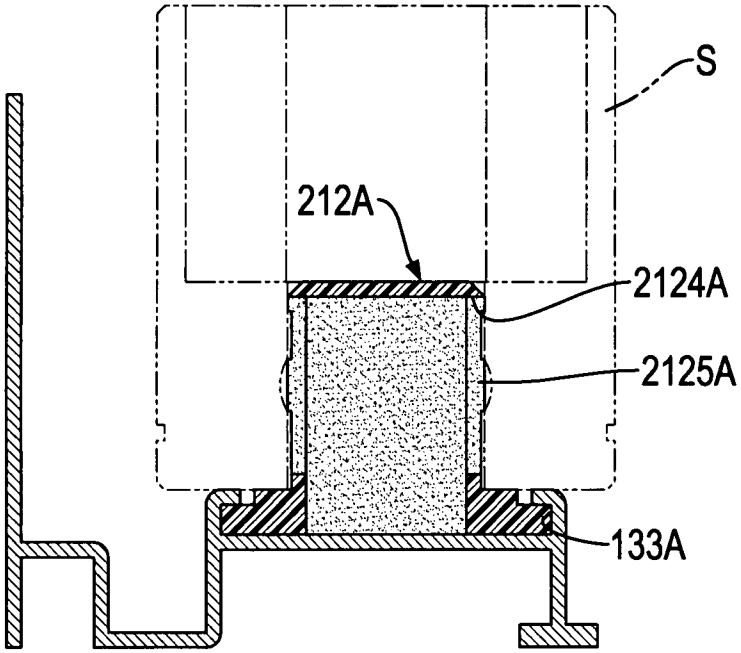
FIG. 5 is an enlarged cross sectional side view of a second embodiment of the sleeve bracket assembly in accordance with the present invention.
Figure 6:
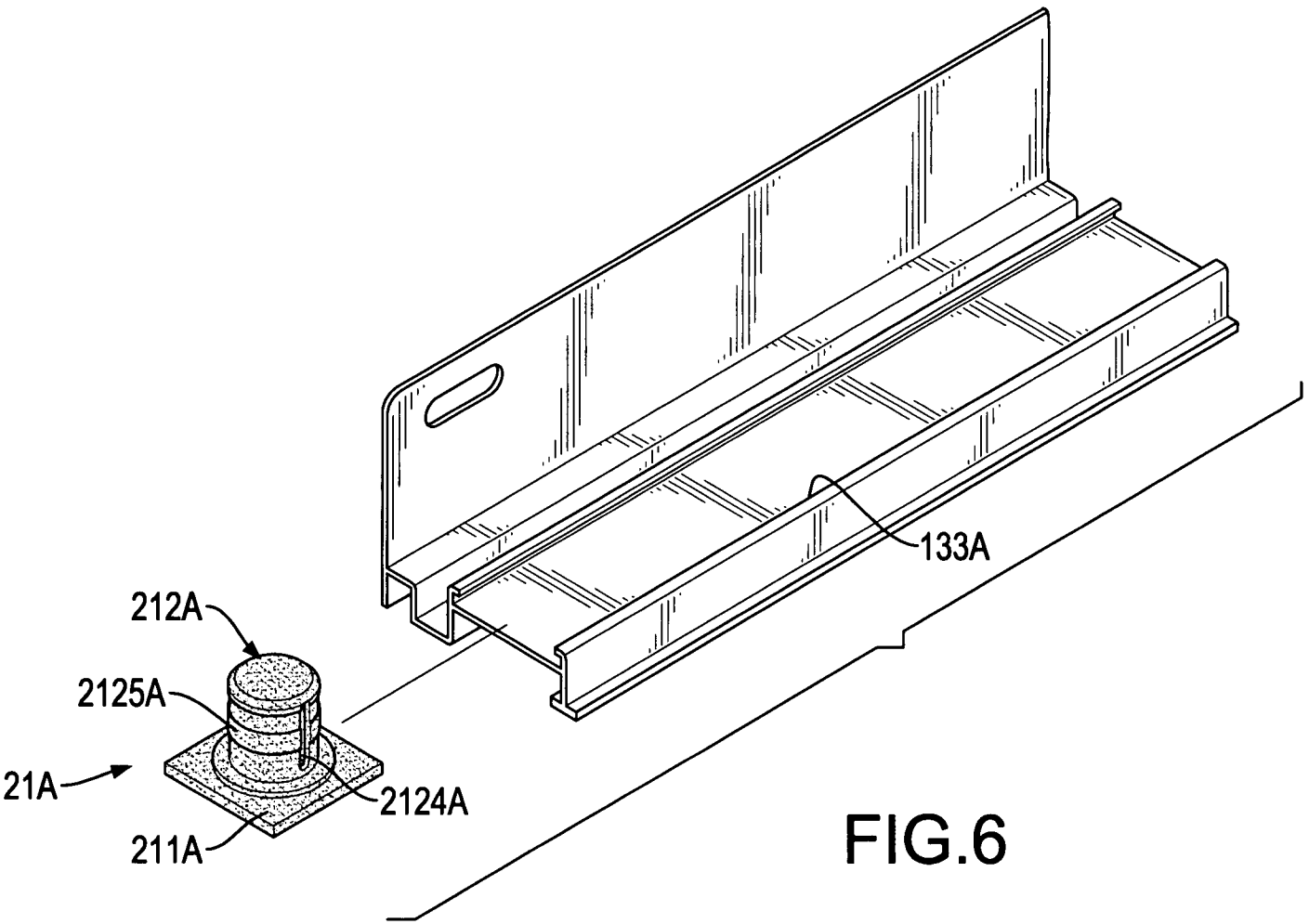
FIG. 6 is a partially exploded perspective view of the sleeve bracket assembly in FIG. 5.
Figure 7:
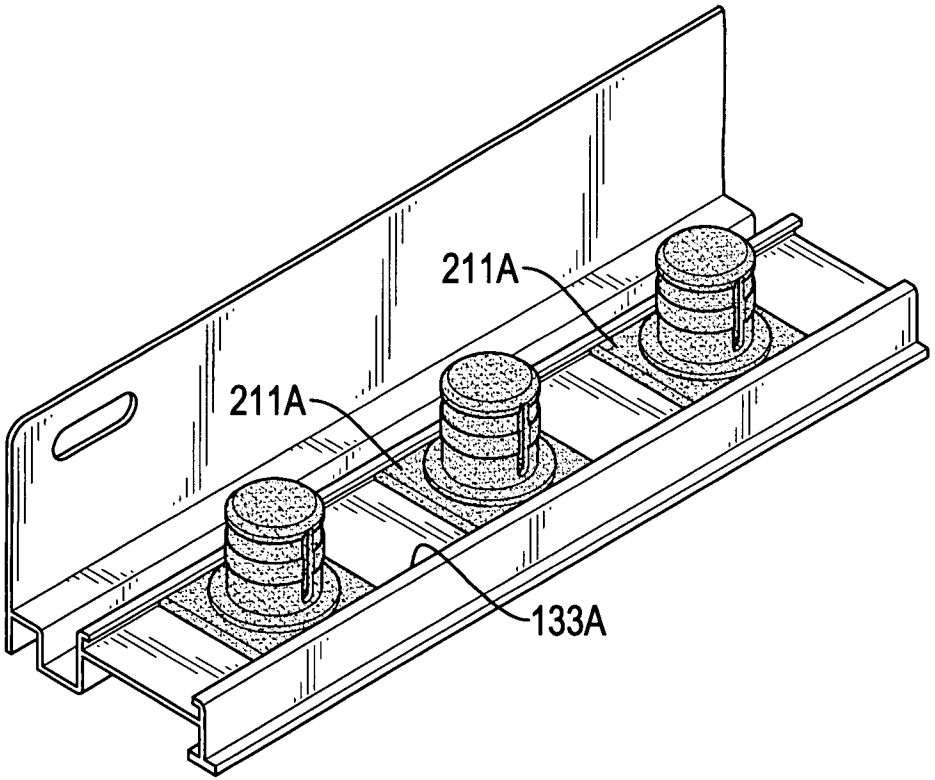
FIG. 7 is an enlarged perspective view in partial section of the sleeve bracket assembly in FIG. 5.
Figure 8:
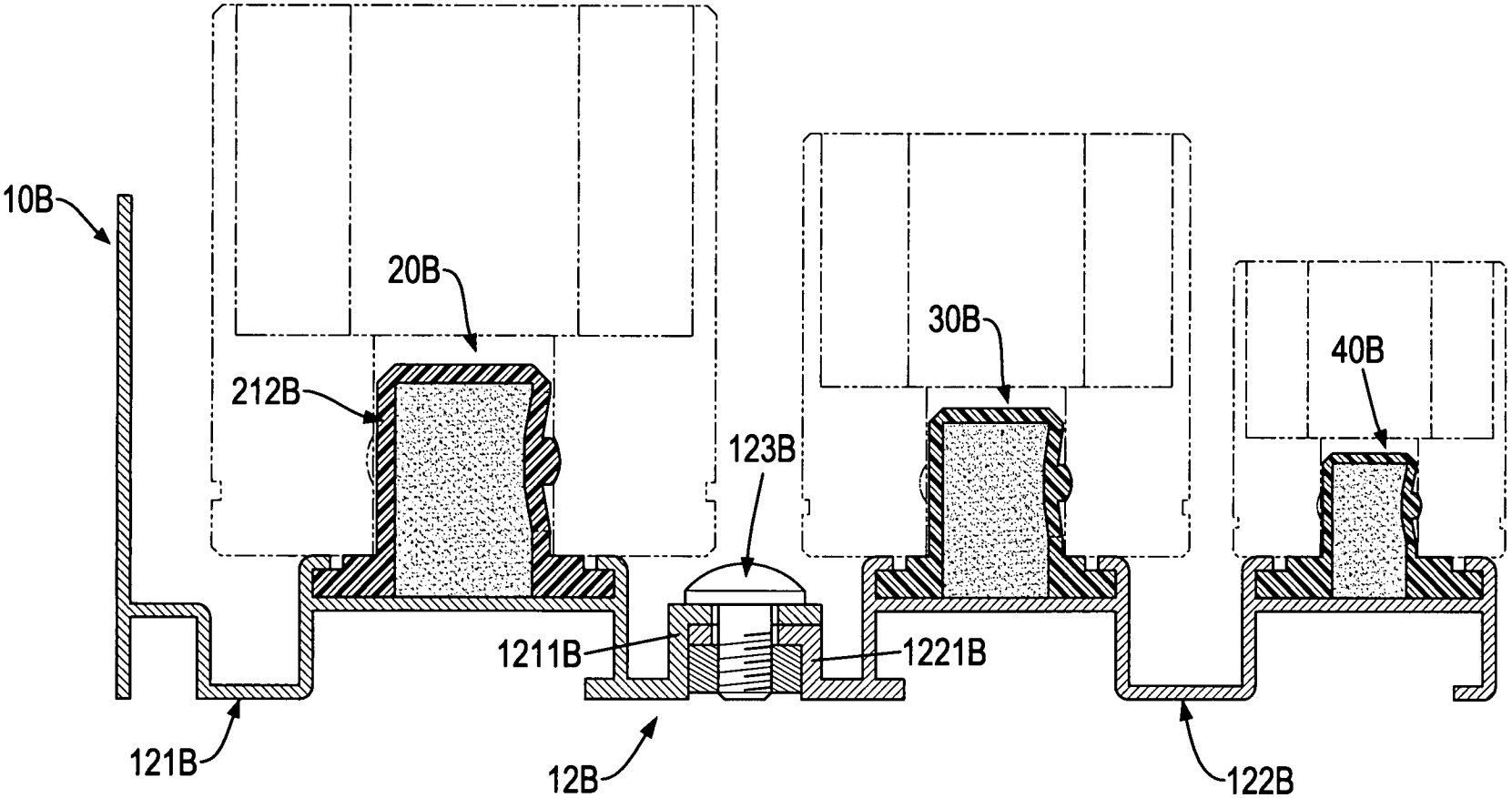
FIG. 8 is an enlarged side view in partial section of a third embodiment of the sleeve bracket assembly in accordance with the present invention.
Figure 9:
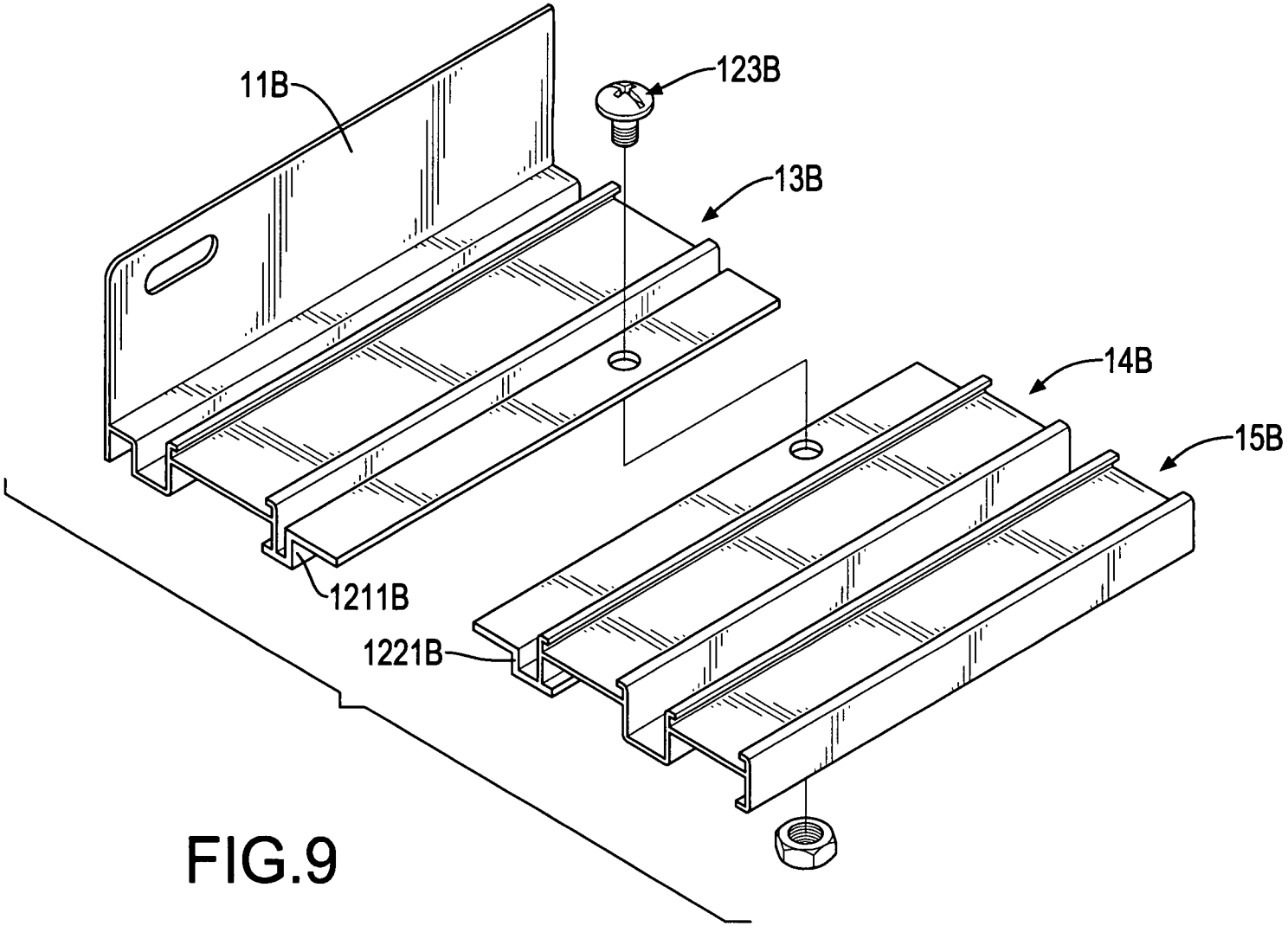
FIG. 9 is a partially exploded perspective view of a frame of the sleeve bracket assembly in FIG. 8.
Figure 10:
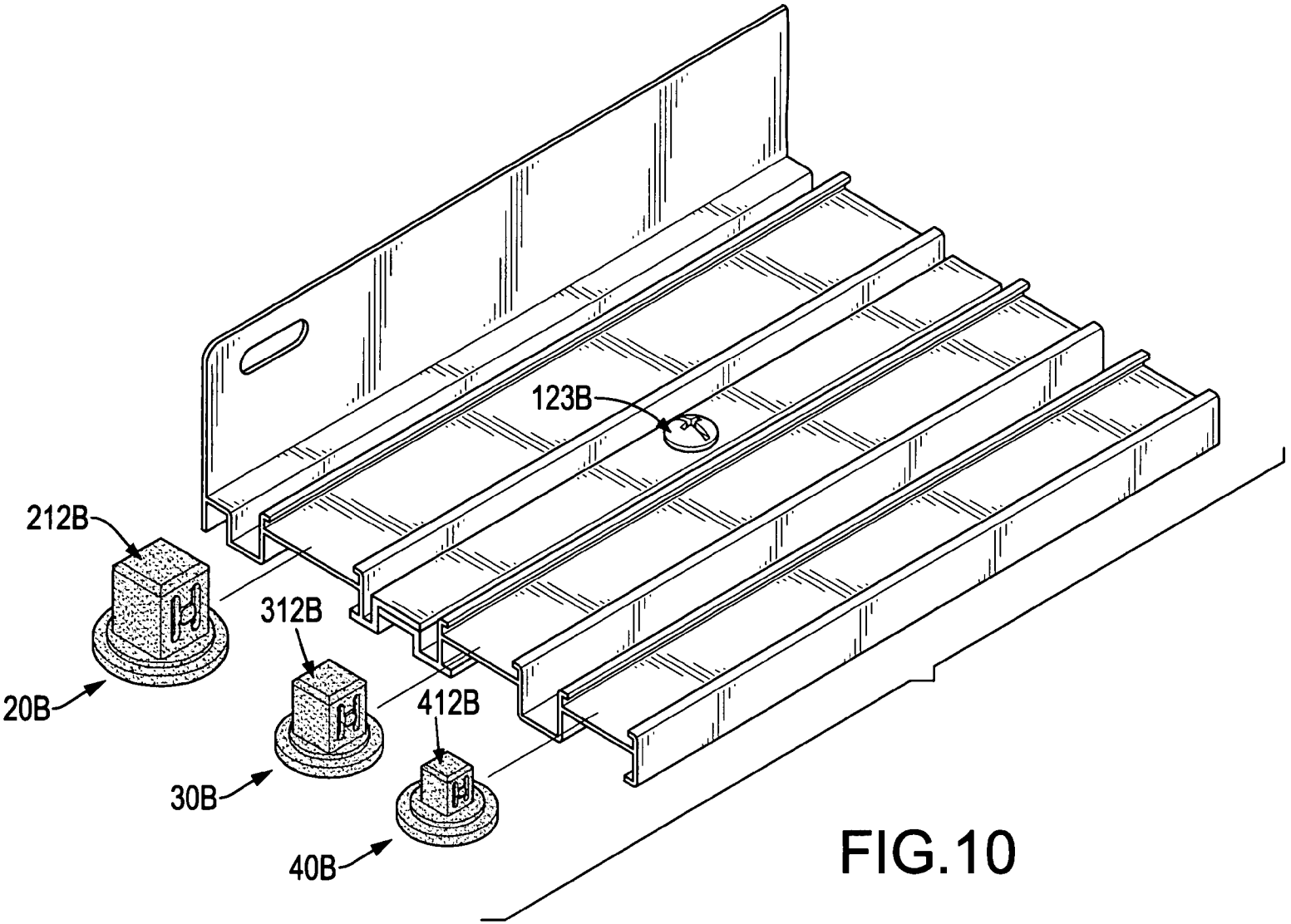
FIG. 10 is a partially exploded perspective view of the sleeve bracket assembly in FIG. 8.
Figure 11:
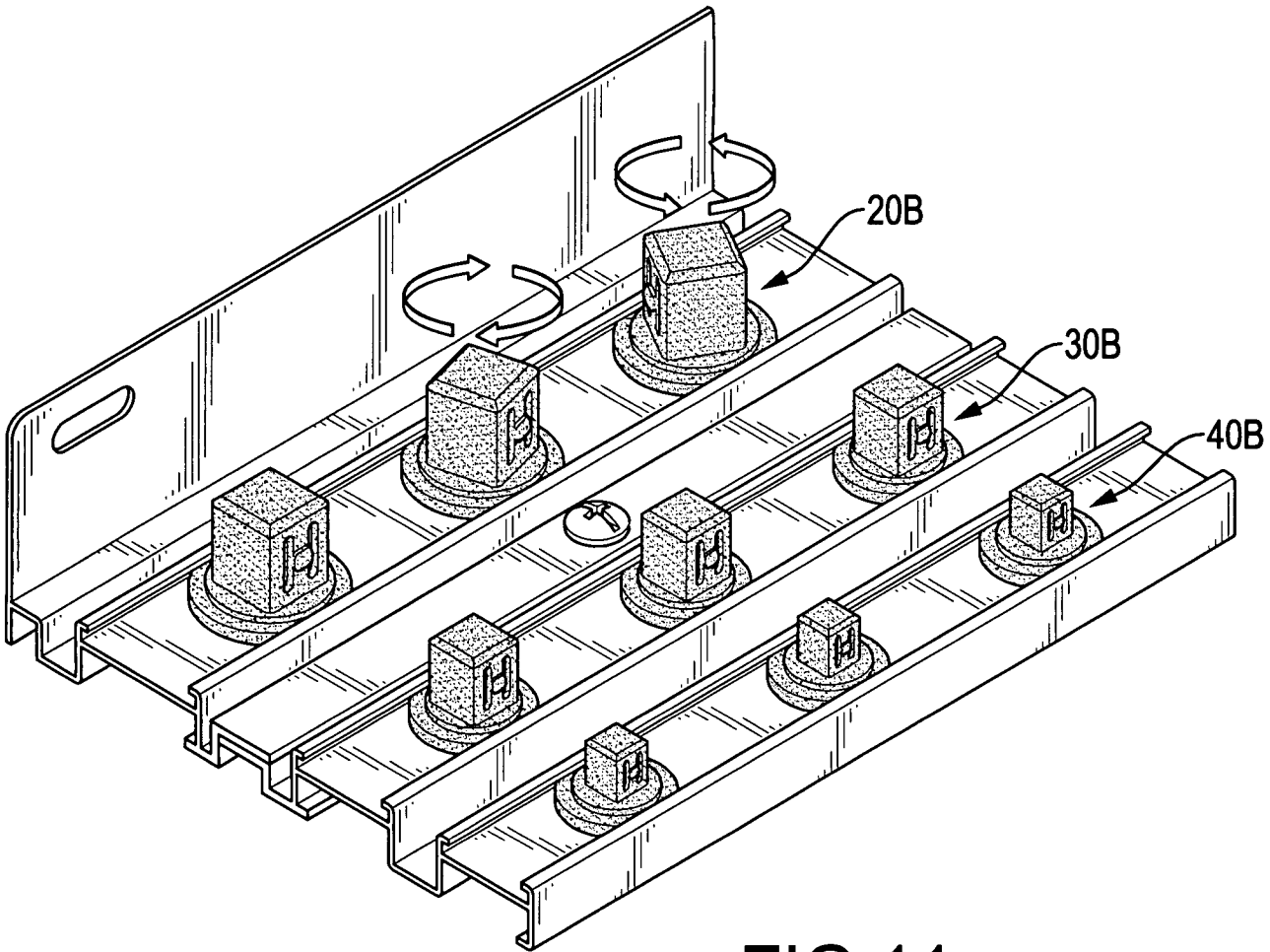
FIG. 11 is an enlarged operational view in partial section of the sleeve bracket assembly in FIG. 8.
Figure 12:
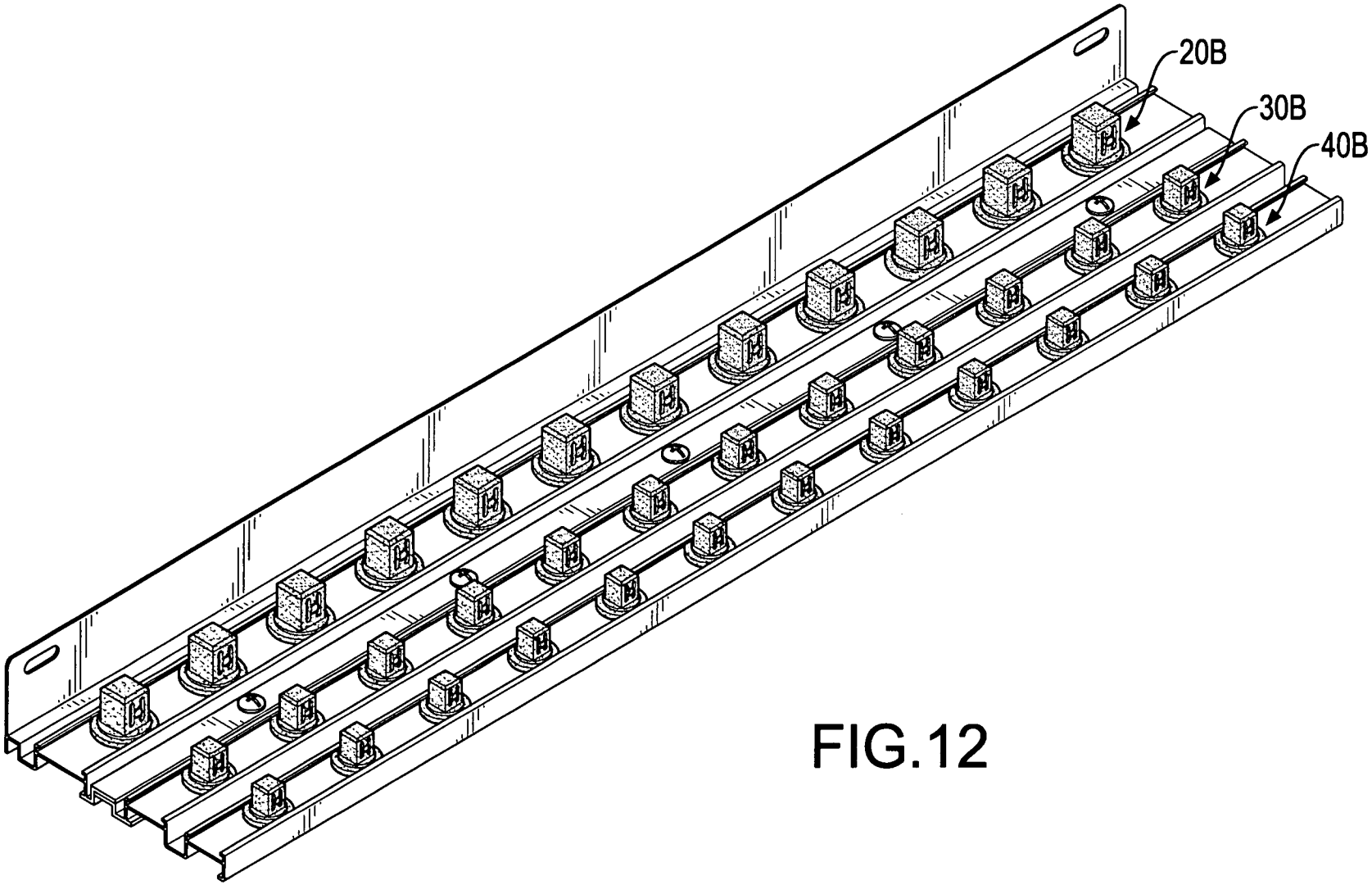
FIG. 12 is a perspective view of the sleeve bracket assembly in FIG. 8.

With reference to FIGS. 5 to 7, a second embodiment of the sleeve bracket assembly is substantially the same as the first embodiment except the following features.

The base 211A of each first sleeve mount 21A has a rectangular cross section and is slidably mounted in the groove 133A. Accordingly, the bases 211A are kept from being rotatable in the grooves 133A.

The positioning button 212A of each first sleeve mount 21A has a round cross section, two opposite sides, two openings 2124A and an annular flange 2125A. The openings 2124A of each positioning button 212A are elongated and are respectively formed through the opposite sides of the positioning button 212A. The flange 2125A of each positioning button 212A radially protrudes from the positioning button 212A. When each sleeve S is inserted by the positioning button 212A, the flange 2125A is pressed inwardly by the inner surface of the sleeve S. Consequently, the flange 2125A recovers and abuts the recess of inner surface of the sleeve S for secure positioning.

Because the cross sections of the positioning buttons 212A are round, the second embodiment can also allow the sleeves S to be rotated.

With reference to FIGS. 8 to 12, a third embodiment of the sleeve bracket assembly is substantially the same as the first embodiment except the following features.

The bracket unit 12B has a first bracket 121B, a second bracket 122B and multiple securing members 123B. The first bracket 121B is elongated and is formed integrally on the side surface of the back plate 11B and has a top surface, a length, a combining section and a connecting side section 1211B. The length of the first bracket 121B is the same as that of the back plate 11B. The combining section is connected integrally with the side surface of the back plate 11B. The connecting side section 1211B is L-shaped and is opposite to the combining section. The first sleeve track 13B is formed on and protrudes from the top surface of the first bracket 121B.

The second bracket 122B is elongated, is connected securely with the connecting side section 1211B of the first bracket 121B and has a top surface, a length and an attaching side section 1221B. The length of the second bracket 122B is the same as that of the back plate 11B. The attaching side section 1221B is L-shaped and abuts the connecting side section 1211B of the first bracket 121B.

Each securing member 123B is mounted through the connecting side section 1211B and the attaching side section 1221B and has a bolt and a nut connected with the bolt.

The frame 10B further has a linear second sleeve track 14B and a linear third sleeve track 15B.

The second sleeve track 14B is linear, protrudes from the top surface of the second bracket 122B and is parallel to the first sleeve track 13B. The first sleeve track 13B is located between the second sleeve track 14B and the back plate 11B.

The third sleeve track 15B is linear, protrudes from the top surface of the second bracket 122B and is parallel to the first sleeve track 13B. The second sleeve track 14B is located between the first sleeve track 13B and the third sleeve track 15B. The third sleeve track 15B and the second sleeve track 14B are substantially the same as the first sleeve track 13B except a width of the first sleeve track 13B is longer than that of the second sleeve track 14B and a width of the second sleeve track 14B is longer than that of the third sleeve track 15B.

The sleeve bracket assembly further has a second mount device 30B and a third mount device 40B that are respectively connected with the second sleeve track 14B and the third sleeve track 15B. The second mount device 30B and the third mount device 40B are substantially the same as the first mount device 20B except a size of each positioning button 212B of the first mount device 20B is larger than that of each positioning button 312B of the second mount device 30B. The size of each positioning button 312B of the second mount device 30B is larger than that of each positioning button 412B of the third mount device 40B. Accordingly, heavier sleeves S can be placed closer to the back plate 11B to prevent the second bracket 122B from being broken.

Figure 13:
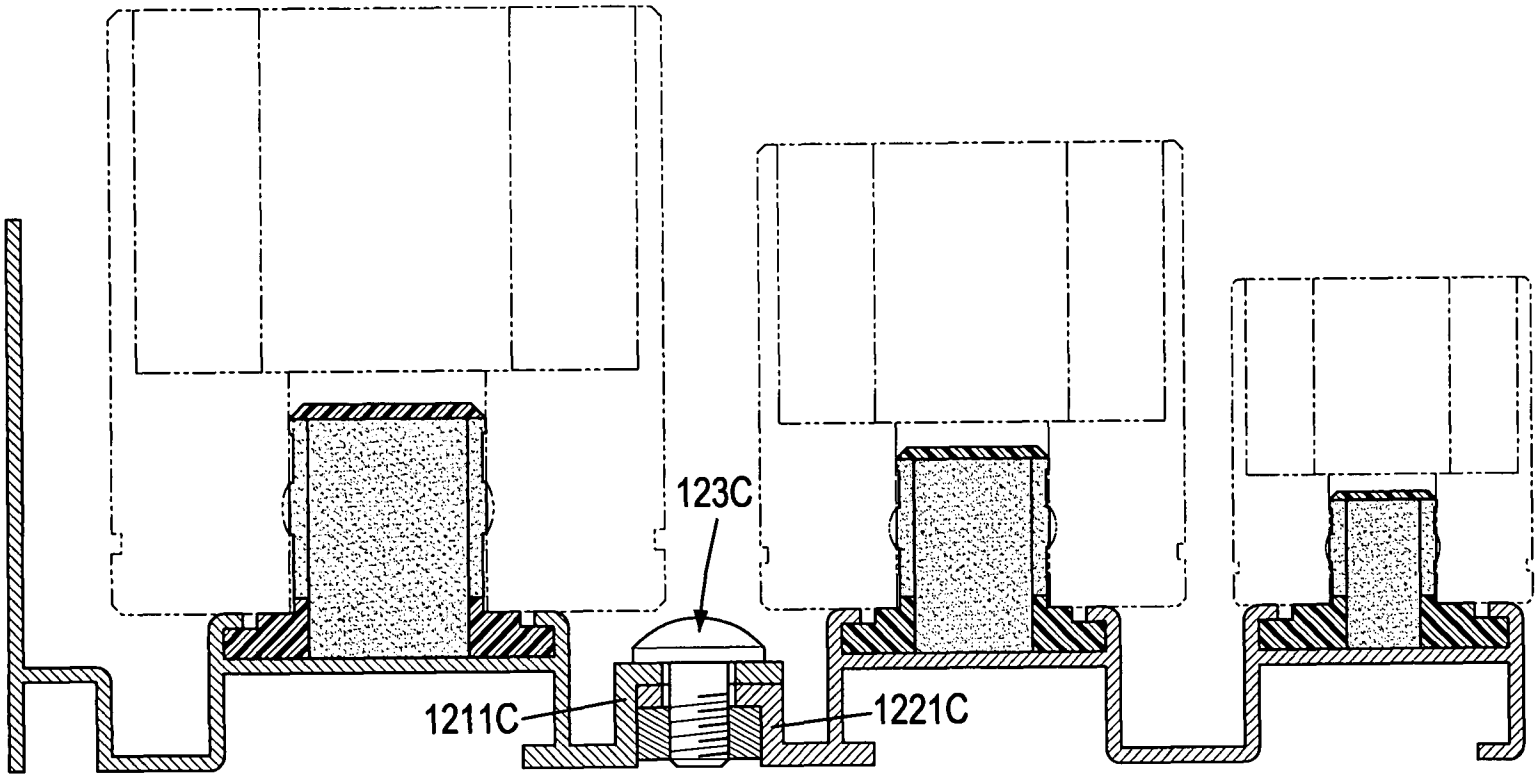
FIG. 13 is an enlarged side view in partial section of a fourth embodiment of the sleeve bracket assembly in accordance with the present invention.
Figure 14:
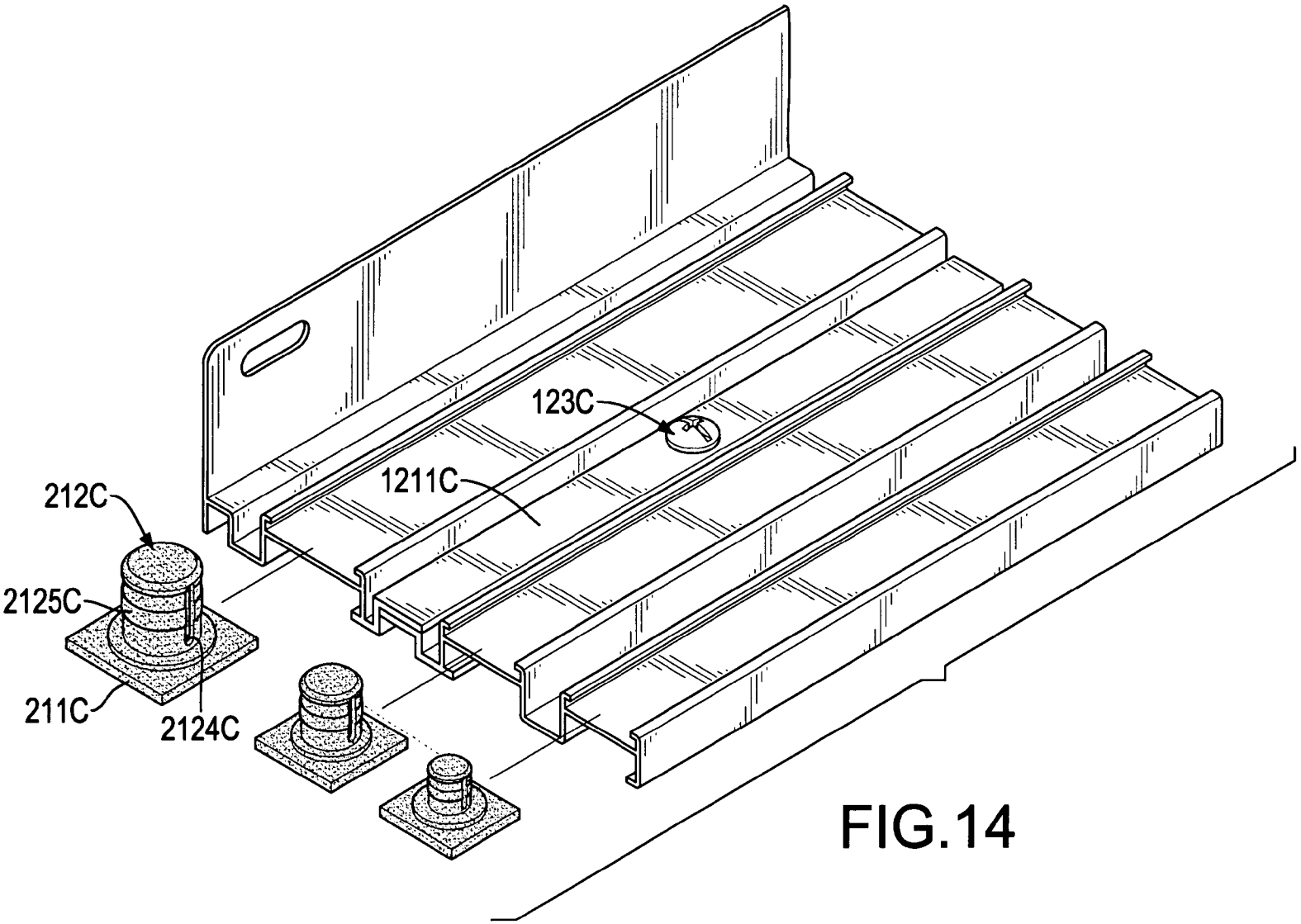
FIG. 14 is a partially exploded perspective view of the sleeve bracket assembly in FIG. 13.
Figure 15:
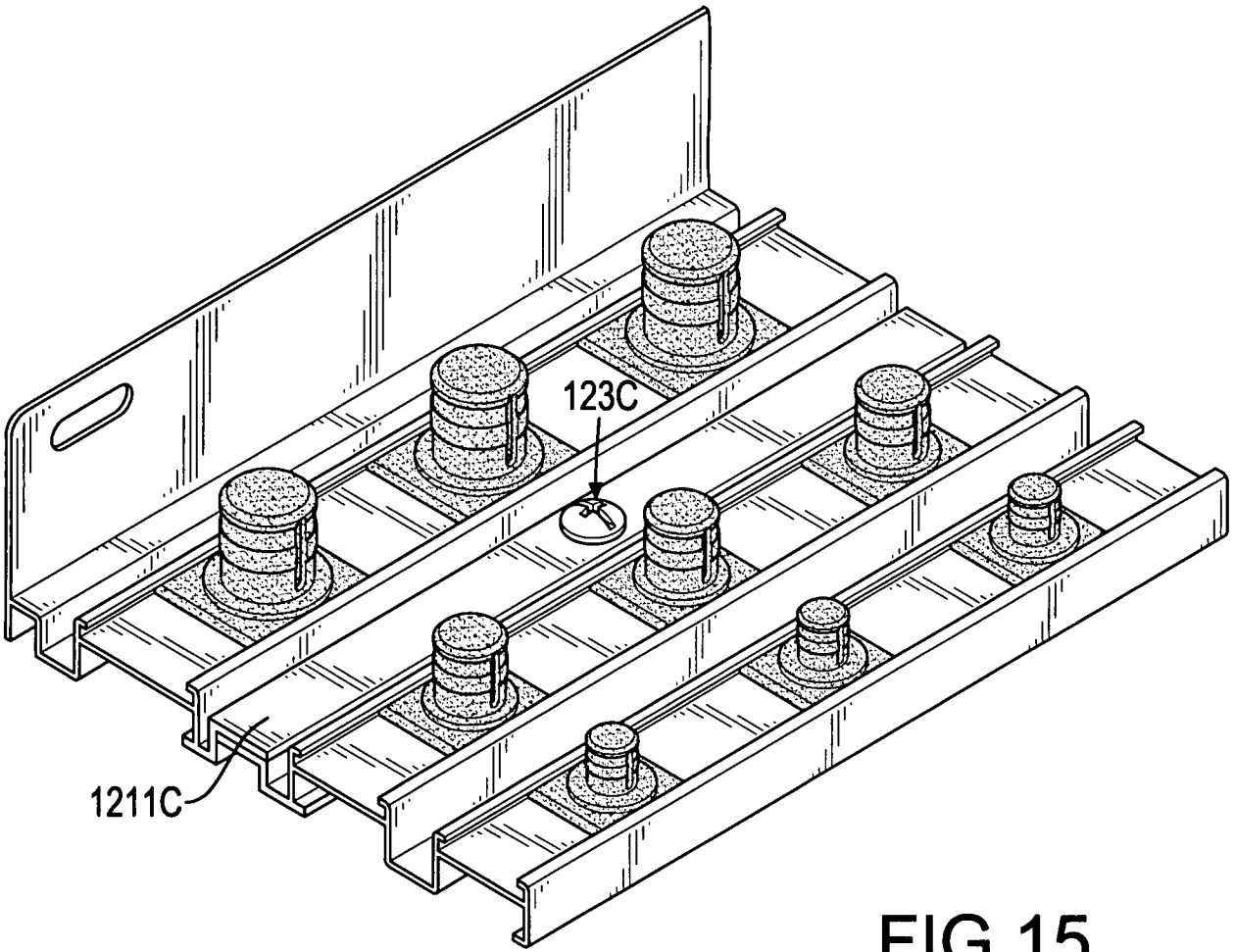
FIG. 15 is an enlarged perspective view in partial section of the sleeve bracket assembly in FIG. 13.

With reference to FIGS. 13 to 15, a fourth embodiment of the sleeve bracket assembly is substantially the same as the third embodiment except each base 211C has a rectangular cross section and each positioning button 212C has two openings 2124C and an annular flange 2125C. The openings 2124C of each positioning button 212C are elongated and are respectively formed through the opposite sides of the positioning button 212C.

From the above description, it is noted that the present invention has the following advantages:

1. Secure Positioning and Rotation Function of the Sleeves S:

The cross sections of the bases 211 or the positioning buttons 212A, 212C are round, so the sleeves S can be rotated. The protrusions 2123 and the flanges 2125A, 2125C can securely position the sleeves S. Accordingly, the sleeve bracket assembly in accordance with the present invention can position the sleeves S firmly and also allow the sleeves S to be rotated.

2. Cost Reduction:

The sleeve bracket assembly in accordance with the present invention can display different sets of sleeves S at the same time and no additional sleeve bracket assembly is required. Accordingly, a user does not have to purchase a new sleeve bracket assembly and carrying one sleeve bracket assembly is convenient.

3. Excellent Versatility:

In the third and fourth embodiments, a user can choose whether the attaching side section 1221B, 1221C of the second bracket 122B is connected with the connecting side section 1211B, 1211C of the first bracket 121B by the securing members 123B, 123C. Accordingly, a format of the sleeve bracket assembly can be changed to meet a user's need and this is versatile and convenient.

What is claimed is:

1. A sleeve bracket assembly comprising:

a frame being made of aluminum and having an elongated back plate having a top;

a bottom opposite to the top of the back plate;

two opposite ends;

a length;

a side surface; and two mounting holes formed through near the top and respectively near the opposite ends of the back plate;

a bracket unit formed integrally on the side surface of the back plate and having an elongated first bracket formed integrally on the side surface of the back plate and having a top surface;

a length equal to the length of the back plate;

a combining section connected integrally with the side surface of the back plate; and an L-shaped connecting side section opposite to the combining section;

an elongated second bracket connected securely with the connecting side section of the first bracket and having a top surface;

a length equal to the length of the back plate; and an L-shaped attaching side section abutting the connecting side section of the first bracket; and multiple securing members, each securing member mounted through the connecting side section and the attaching side section and having a bolt and a nut connected with the bolt;

a linear first sleeve track formed on and protruding from the top surface of the first bracket of the bracket unit, extending along a line parallel to an extending line of the back plate and having a width;

a rectangular top surface having two opposite edges;

two bars respectively formed on the edges of the top surface of the first sleeve track, each bar having a bent top facing the bent top of the other bar; and a groove formed between the top surface of the first sleeve track and the bars;

a linear second sleeve track formed on and protruding from the second bracket, parallel to the first sleeve track to locate the first sleeve track between the second sleeve track and the back plate and having a width being shorter than the width of the first sleeve track; and a linear third sleeve track formed on and protruding from the second bracket and parallel to the second sleeve track;

a first mount device having multiple first sleeve mounts detachably connected with the first sleeve track, each first sleeve mount having a base slidably and rotatably mounted in the first sleeve track and having a top surface and a round cross section; and a hollow positioning button formed on and protruding from the top surface of the base and having a rectangular cross section;

a side surface;

two elongated openings respectively formed through the side surface of the positioning button;

a resilient section formed between the openings of the positioning button and having a central segment; and a protrusion formed on and protruding outward from the central segment of the resilient section; and a second mount device connected with the second sleeve track and having multiple positioning buttons;

wherein the positioning buttons of the first mount device have a same size and the positioning buttons of the second mount device have a same size; and the size of each positioning button of the first mount device is larger than the size of each positioning button of the second mount device.

2. A sleeve bracket assembly comprising:

a frame being made of aluminum and having an elongated back plate having a top;

a bottom opposite to the top of the back plate;

two opposite ends;

a length;

a side surface; and two mounting holes formed through near the top and respectively near the opposite ends of the back plate;

a bracket unit formed integrally on the side surface of the back plate and having an elongated first bracket formed integrally on the side surface of the back plate and having a top surface;

a length equal to the length of the back plate;

a combining section connected integrally with the side surface of the back plate; and an L-shaped connecting side section opposite to the combining section;

an elongated second bracket connected securely with the connecting side section of the first bracket and having a top surface;

a length equal to the length of the back plate; and an L-shaped attaching side section abutting the connecting side section of the first bracket; and multiple securing members, each securing member mounted through the connecting side section and the attaching side section and having a bolt and a nut connected with the bolt;

a linear first sleeve track formed on and protruding from the top surface of the first bracket of the bracket unit, extending along a line parallel to an extending line of the back plate and having a width;

a rectangular top surface having two opposite edges;

two bars respectively formed on the edges of the top surface of the first sleeve track, each bar having a bent top facing the bent top of the other bar; and a groove formed between the top surface of the first sleeve track and the bars;

a linear second sleeve track formed on and protruding from the second bracket, parallel to the first sleeve track to locate the first sleeve track between the second sleeve track and the back plate and having a width being shorter than the width of the first sleeve track; and a linear third sleeve track formed o and protruding from the second bracket and parallel to the second sleeve track;

a first mount device having multiple first sleeve mounts detachably connected with the sleeve track, each first sleeve mount having a base slidably mounted in the first sleeve track and having a top surface and a rectangular cross section; and a hollow positioning button formed on and protruding from the top surface of the base and having a round cross section;

two opposite sides;

two elongated openings respectively formed through the opposite sides of the positioning button; and an annular flange radially protruding from the positioning button;

a second mount device connected with the second sleeve track and having multiple positioning buttons;

wherein the positioning buttons of the first mount device have a same size and the positioning buttons of the second mount device have a same size; and the size of each positioning button of the first mount device is larger than the size of each positioning button of the second mount device.

* * * * *